US007995955B2

(12) United States Patent
Izumi et al.

(10) Patent No.: US 7,995,955 B2
(45) Date of Patent: Aug. 9, 2011

(54) IMAGE FORMING APPARATUS, DEVELOPING DEVICE AND DEVELOPER DISCHARGE MECHANISM

(75) Inventors: Takao Izumi, Kanagawa-ken (JP); Hiroshi Murata, Kanagawa-ken (JP); Norikazu Ochiai, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 208 days.

(21) Appl. No.: 12/499,207

(22) Filed: Jul. 8, 2009

(65) Prior Publication Data

US 2010/0008701 A1 Jan. 14, 2010

Related U.S. Application Data

(60) Provisional application No. 61/078,931, filed on Jul. 8, 2008.

(51) Int. Cl.
*G03G 15/08* (2006.01)

(52) U.S. Cl. ..... 399/257

(58) Field of Classification Search ..... 399/257, 399/254, 255, 256, 27, 29, 99, 120, 122, 399/222, 258, 259, 260, 264, 358
See application file for complete search history.

(56) References Cited

U.S. PATENT DOCUMENTS

| | | | | |
|---|---|---|---|---|
| 5,479,247 | A * | 12/1995 | Watanabe et al. | 399/120 |
| 6,418,291 | B1 * | 7/2002 | Sakemi | 399/257 |
| 6,587,661 | B1 * | 7/2003 | Shimmura et al. | 399/257 |
| 7,376,374 | B2 * | 5/2008 | Adachi | 399/254 |
| 2006/0222411 | A1 * | 10/2006 | Kumar et al. | 399/257 |
| 2006/0239720 | A1 * | 10/2006 | Hirota et al. | 399/258 |
| 2007/0269235 | A1 * | 11/2007 | Hirose | 399/254 |
| 2009/0154972 | A1 * | 6/2009 | Tanaka et al. | 399/358 |

FOREIGN PATENT DOCUMENTS

| | | |
|---|---|---|
| JP | 7-301984 | 11/1995 |
| JP | 9-185177 | 7/1997 |

* cited by examiner

*Primary Examiner* — David P Porta
*Assistant Examiner* — Kiho Kim
(74) *Attorney, Agent, or Firm* — Turocy & Watson, LLP

(57) ABSTRACT

In order to provide an image forming apparatus capable of maintaining the image quality by making smooth flowability of a surplus developer, which is discharged according to supply of a new developer (toner and carrier), toward a collection box, there are provided a stirring screw that electrify toner by stirring the toner together with a carrier; a casing that supports the stirring screw and stores a developer in which the toner and the carrier are mixed; a inlet used to supply the developer to the casing; a guide that guides the surplus developer discharged from the casing downward; and a reciprocating member that moves on a flow surface of the guide along which the surplus developer flows.

14 Claims, 5 Drawing Sheets

X
Z
X
Y
Y
Z
32
32a
32b
64
61
63
R
62
60
32
64
63
62
R
32
61
64
62

EXAMPLE (WITH MOVING MEMBER)

| | | ANGLE OF REPOSE OF DEVELOPER (° ) | | |
|---|---|---|---|---|
| | | 35 | 38 | 40 |
| SLOPE ANGLE (° ) | 40 | ○ | ○ | ○ |
| | 55 | ○ | ○ | ○ |
| | 65 | ○ | ○ | ○ |

FIG. 5A

COMPARATIVE EXAMPLE (NO MOVING MEMBER)

| | | ANGLE OF REPOSE OF DEVELOPER (° ) | | |
|---|---|---|---|---|
| | | 35 | 38 | 40 |
| SLOPE ANGLE (° ) | 40 | ○ | × | × |
| | 55 | ○ | ○ | × |
| | 65 | ○ | ○ | ○ |

FIG. 5B

IMAGE FORMING APPARATUS, DEVELOPING DEVICE AND DEVELOPER DISCHARGE MECHANISM

CROSS-REFERENCE TO RELATED APPLICATIONS

This application is based upon and claims the benefit of priority from U.S. provisional application 61/078,931, filed on Jul. 8, 2008, the entire contents of each of which are incorporated herein by reference.

TECHNICAL FIELD

The present invention relates to an image forming apparatus that forms an image by transferring electrified toner onto a transferred body and in particular, to a discharge technology of a deteriorated developer.

BACKGROUND

In an image forming apparatus that adopts a developing system of transferring electrified toner onto a transferred body, a developer in which toner and carrier are mixed is stirred so that the toner electrified by friction.

In addition, only electrified toner of the developer is carried on a surface of a photoconductive drum and is transferred onto the transferred body, and the carrier remains in the developing device.

Accordingly, the toner concentration of the developer stored in the developing device is reduced by repetition of processing of developing an image.

For this reason, a developer is supplied to the developing device from an external toner tank when the concentration of toner becomes smaller than a threshold value.

This supply is performed including not only toner but also carrier because a coat agent of a carrier is pealed off or dropped or an additive of toner adheres to the carrier surface due to stirring in developing device.

In addition, an old surplus developer (developer with reduced toner concentration) generated by supply of the new developer is discharged from the developing device and is then collected (for example, JP-A-9-185177).

Meanwhile, in a transport path along which the surplus developer is discharged from an outlet of the developing device and reaches a collection box, there exists a place where the developer flows by gravity.

However, the flowability of the developer in the transport path may be stopped by a decrease in fluidity of the developer caused by abrasion and deterioration of the carrier.

Thus, when the smooth flow of the surplus developer to the collection box is obstructed, the outlet is clogged and the amount of developer stored in the developing device increases up to a value larger than a defined value. As a result, a problem that the quality of a formed image is lowered occurs.

SUMMARY

The invention was made in view of such a situation, and it is an object of the invention to provide an image forming apparatus, developing device and a developer discharge mechanism capable of maintaining the image quality by making smooth flow of a surplus developer, which is discharged according to supply of a new developer (toner and carrier), toward a collection box.

According to an aspect of the invention, an image forming apparatus includes: a developing device that electrify toner by stirring together with a carrier, and make toner image carried on a photoconductive drum; a supply portion that supplies a developer, in which the toner and the carrier are mixed, to the developing device; a collection portion that collects the surplus developer discharged from the developing device; a guide that guides the surplus developer from the developing device to the collection portion; and a reciprocating member that moves on a flow surface of the guide along which the surplus developer flows.

DESCRIPTION OF THE DRAWINGS

FIG. 5A is a table which summarizes an experimental result in the developer discharge mechanism according to the embodiment in order to prove the effects of the invention; and FIG. 5B is a table which summarizes an experimental result in a comparative example where there is no reciprocating member.

DETAILED DESCRIPTION

Hereinafter, embodiments of the invention will be described on the basis of the accompanying drawings.

Figure 1A:
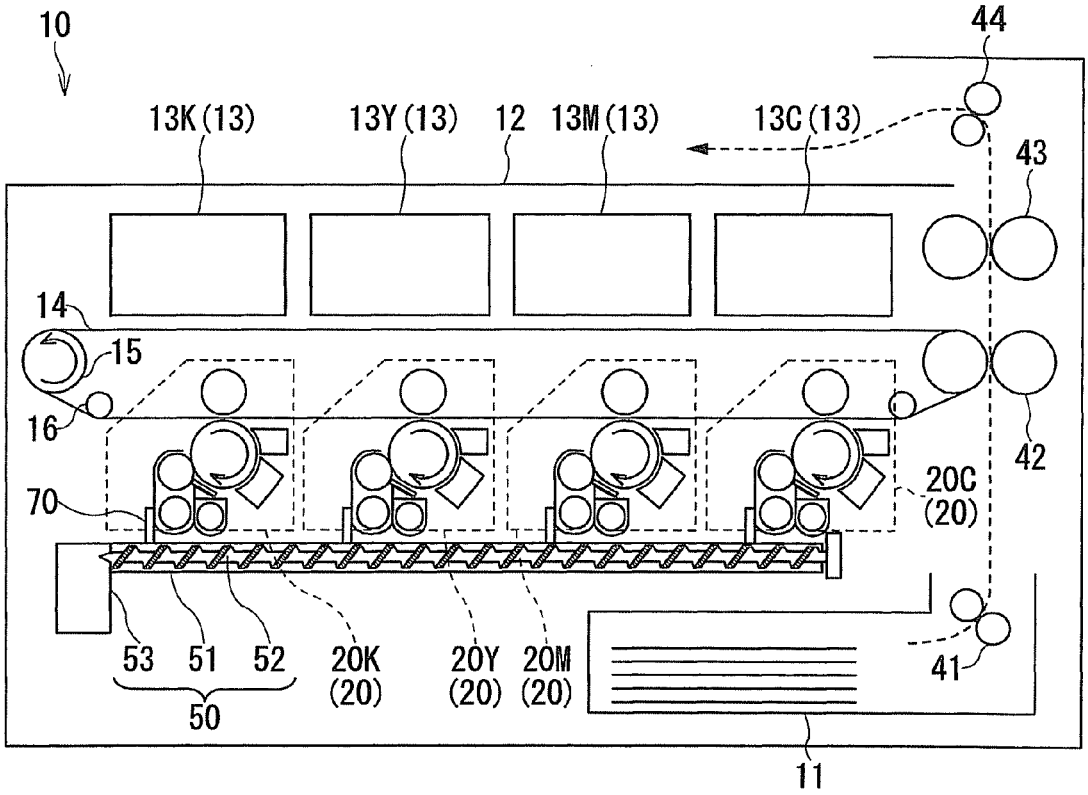
FIG. 1A is a view illustrating the configuration of an embodiment of an image forming apparatus of the invention.

An image forming apparatus 10 shown in FIG. 1A is configured to include: a transfer belt (transferred body) 14 which rotates an orbit, which is defined by a driving wheel 15 and a driven wheel 16, at a predetermined speed; a developing unit 20 (20K, 20Y, 20M, 20C) to which each color material is supplied from a toner tank 13 (13K, 13Y, 13M, 13C) and which transfers a toner image of each color to the transfer belt 14; a collection portion 50 which collects a surplus developer from the developing unit 20 through a guide 70; a paper cassette 11 in which the paper is placed in a bundle; a paper feed roller 41 which supplies the paper from the paper cassette 11 one by one; a secondary transfer roller 42 which transfers onto the supplied paper a toner image transferred onto the transfer belt 14; a fixing roller 43 which fixes the toner image, which is transferred on the supplied paper, onto a surface of the paper; and a paper roller 44 which guides the paper, on which the toner image is fixed, to a paper tray 12.

The image forming apparatus 10 configured as described above outputs a color image obtained by printing four colors of black K, yellow Y, magenta M, and cyan C on the paper so as to overlap on the basis of image data read by a scanner (not shown) or transmitted from a terminal device.

The toner tank 13 (13K, 13Y, 13M, 13C) contain a developer which is mixed toner and carrier. The toner is color materials of black K and the three primary colors (yellow Y, magenta M, cyan C) and particle diameter of about 10 μm. And a carrier, which is a magnetic particle that is iron powder or ferrite powder and which has a particle diameter of about 50 to 150 μm.

Moreover, toner tank 13 is replaced with the new one when the developer contained is consumed by image output of the image forming apparatus 10.

The transfer belt 14 is an endless (seamless) belt which has a width almost equal to a length of photoconductive drum 21 in a direction (depth direction of the drawing) perpendicular to the carrying direction.

In addition, the transfer belt 14 is stretched over several driven wheels 16 and the driving wheel 15 rotating at a predetermined speed, and the developing unit 20 (20K, 20Y, 20M, 20C) of each color is arrayed in order.

In addition, the transfer belt 14 is a transferred body which moves at the same speed as the circumferential speed of the photoconductive drum 21 and in the same direction and onto which a toner image of each color (K, Y, M, C) carried on each photoconductive drum 21 is transferred in order by overlap printing.

The paper cassette 11 is provided at a lower side of the image forming apparatus 10 and receives the paper therein. Moreover, the paper feed roller 41 picks up the paper from the paper cassette 11 one by one and sends the paper in a direction shown by a broken line in the drawing.

The secondary transfer roller 42 serves to transfer a multicolor toner image, which was transferred from the developing unit 20 (20K, 20Y, 20M, 20C) onto the transfer belt 14 by overlap printing, onto paper.

The secondary transfer roller 42 collectively transfers the multicolor toner image from the transfer belt 14 onto the paper by an electric field formed when a predetermined bias voltage is applied between opposite rollers provided with the transfer belt 14 interposed therebetween.

The fixing roller 43 melts toner by applying heat and pressure to the paper, on which the multicolor toner image is transferred, so that the toner can be entangled with the fiber of the paper to be then fixed. The paper on which formed the color image is going upward to the paper tray 12 by the paper roller 44.

The collection portion 50 is configured to include a carrying tube 51, a collection screw 52, and a collection box 53 and serves to collect a surplus developer, which is discharged from each developing unit 20 (20K, 20Y, 20M, 20C), through the guide 70.

The carrying tube 51 is connected to a developing device 30 of each developing unit 20 through the guide 70 and serves to transport a surplus developer, which drops due to the gravity, to the collection box 53 by the collection screw 52 rotating within the carrying tube 51.

The collection box 53 is configured to be detachable from the image forming apparatus 10 and is also configured such that a surplus developer collected and deposited can be discarded.

Figure 1B:
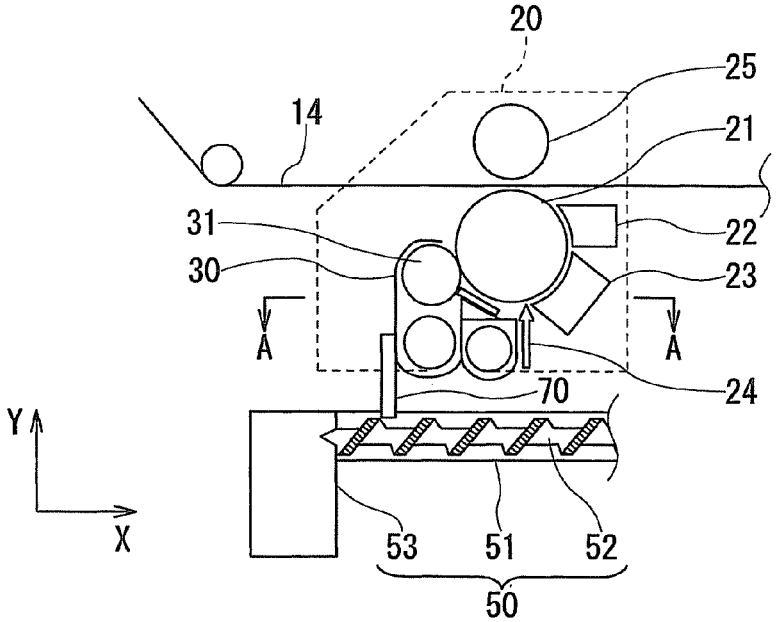
FIG. 1B is an enlarged view illustrating a developing unit.

As shown in FIG. 1B, the developing unit 20 has an electric charger 23, an exposure device (not shown) which outputs exposure light 24, the developing device 30 which supports a developing roller 31, a primary transfer roller 25 located with the transfer belt 14 interposed between the photoconductive drum 21 and the primary transfer roller 25, and a cleaner 22 which are provided around the photoconductive drum 21 along the rotation direction.

Moreover, the guide 70 which guides a surplus developer discharged from the developing device 30 to the collection portion 50 is connected to the developing unit 20.

The photoconductive drum 21 rotates not to slide on the developing roller 31 and the transfer belt 14 and has a cylindrical shape with a diameter of about 30 mm. The photoconductive drum 21 is a photoconductor in which only a portion that receives the exposure light 24 is changed from an insulator to a conductor.

The electric charger 23 applies a voltage difference of 1 kV to 2 kV between the electric charger 23 and the photoconductive drum 21 to continuously cause corona discharge, so that the surface of the photoconductive drum 21 is uniformly charged to about −600 V with static electricity.

The exposure light 24 is output from an exposure device (not shown) and is irradiated to a surface of the photoconductive drum 21 charged uniformly according to an image to be formed to thereby form an electrostatic latent image.

That is, a light beam is irradiated on and off from the exposure device to thereby form a static electricity pattern image according to conductive and insulating regions formed on the surface of the photoconductive drum 21.

A magnet is disposed inside the developing roller 31. When the developing roller 31 rotates, a carrier contained in the developing device 30 adheres to the surface of the developing roller 31 together with toner.

In addition, a negative bias voltage of −380 V is applied to the developing roller 31, such that an electric field is formed between the developing roller 31 and the photoconductive drum 21. That is, in a portion with no static electricity by the exposure light 24, of the surface of the photoconductive drum 21 on which the static electricity pattern is formed, an electric field is formed in a direction in which the negatively electrified toner moves. On the other hand, in a portion with static electricity of the surface of the photoconductive drum 21, the direction of the electric field is inverted. Accordingly, the toner cannot move.

Thus the toner image of each color ingredient of a picture is carried on each photoconductive dram 21 in the developing unit 20 (20K, 20Y, 20M, 20C).

A bias voltage of about +1 kV is applied to the primary transfer roller 25 by a voltage application unit (not shown), such that an electric field is formed between the primary transfer roller 25 and the photoconductive drum 21. Then, by this electric field, the toner image carried on the photoconductive drum 21 is transferred onto the transfer belt 14.

Then, toner images corresponding to other colors can be made to overlap the toner image, which was already transferred, by increasing the bias voltage applied to the primary transfer roller 25 in each developing unit 20 (20K, 20Y, 20M, 20C) to +1.0 V, +1.2 kV, +1.4 kV, and +1.6 kV gradually in this order.

The cleaner 22 serves to remove the toner which remains on the photoconductive drum 21 without being transferred onto the transfer belt 14. Specifically, the cleaner 22 is configured to include a brush being in contact with the surface of the photoconductive drum 21 and a blade made of rubber.

Figure 2A:
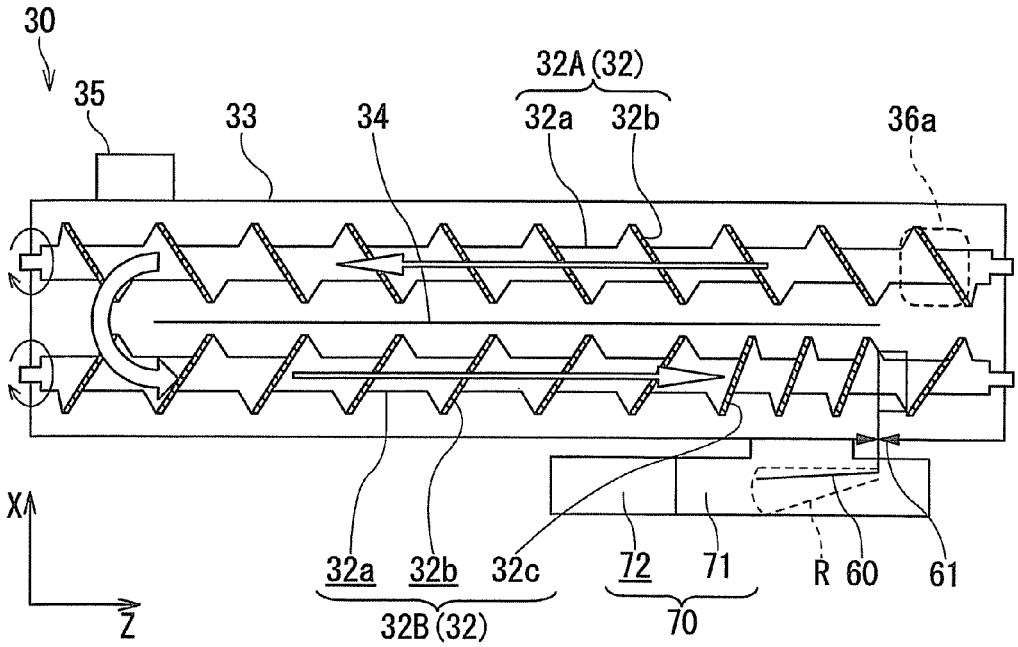
FIG. 2A is a horizontal sectional view illustrating an embodiment of a developer discharge mechanism of the invention.
Figure 2B:
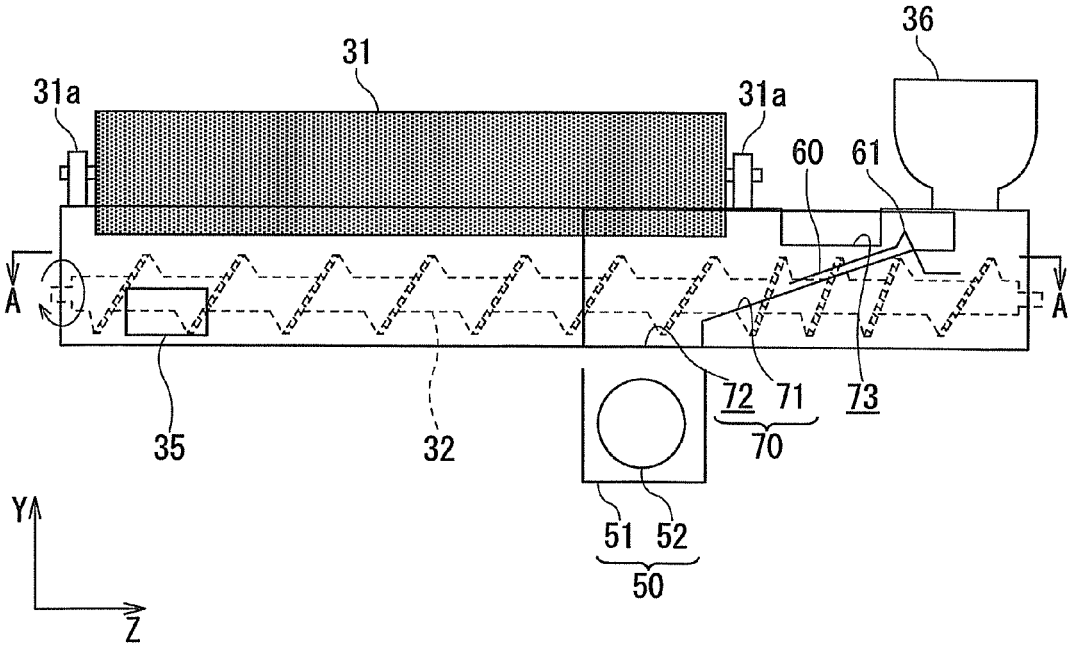
FIG. 2B is a side view illustrating a developer discharge mechanism.

As shown in FIG. 2A, which is a horizontal sectional view taken along the line IIA-IIA of FIG. 1B, and FIG. 2B which is the side view. The developing device 30 is configured to include the developing roller 31, a stirring screw 32 (32A, 32B), a casing 33, a dividing plate 34, a concentration sensor 35, a supply portion 36, a reciprocating member 60, and the guide 70.

The developing device 30 configured in this way contains a developer corresponding to one of the colors (black K, yellow Y, magenta M, cyan C) and electrify a toner by stirring together with a carrier.

The stirring screw 32 is configured to include the going-path stirring screw 32A and the returning-path stirring screw 32B, and spiral flights 32*b* and 32*c* are formed on a shaft 32*a* which performs axial rotation.

The casing 33 supports the going-path stirring screw 32A and the returning-path stirring screw 32B in parallel separated from each other by the dividing plate 34 and contain a developer thereinside.

In addition, by rotating the two stirring screws 32 simultaneously, the developer contained can be circulated in the casing 33 in a direction indicated by the arrow in the drawing.

Thus, since carrier and toner rub on each other within the developing device 30, the carrier is electrified to plus (+) and the toner is electrified to minus (−). Accordingly, the toner is attracted to the carrier.

The supply portion 36 is provided at a inlet 36*a* opened to the casing 33 and serves to supply a developer, in which the toner and the carrier are mixed, from the toner tank 13 (FIG. 1A) to the developing device 30.

That is, when a toner image is developed on the transferred body, the toner concentration in the developer is reduced since only the toner in the casing 33 is consumed. Then, the concentration sensor 35 detects it, and a developer is supplied into the casing 33 by operating a supply portion 36 so that the toner concentration is maintained constant.

In addition, a outlet 73 is provided on a side surface of the casing 33 so that a surplus developer overflows to be discharged from the outlet 73 as much as a developer supplied from the supply portion 36. Accordingly, the amount of developer in the developing device 30 is maintained constant and an old deteriorated carrier is replaced with a new carrier little by little.

In addition, the flight 32*c* of a portion of the stirring screw 32B located near the outlet 73 has a pitch set smaller than the flight 32*b* of the other portions. Accordingly, the flow of a developer slow down in the portion of the flight 32*b*, a developer level is rise, and it becomes easily discharged from the outlet 73.

Moreover, a through hole serving as a rotation center 61 of the reciprocating member 60 is provided on a side surface of the casing 33 near the outlet 73.

The guide 70 is configured to include a slope 71, which is inclined with respect to a horizontal plane at a lower side of the outlet 73 in the vertical direction, and a hole 72 which continues from the slope 71 and is connected to the carrying tube 51 of the collection portion 50. In addition, the reciprocating member 60, which will be described later, is disposed at the slope 71.

The guide 70 configured as described above serves to make a surplus developer overflowed from the outlet 73 flow onto the slope 71 and to guide the surplus developer to the collection portion 50 through the hole 72.

Here, if an angle of inclination of the slope 71 is small, the gravity component in the inclination direction is decreased. As a result, a developer dropped from the outlet 73 may be deposited without flowing. On the other hand, if the angle of inclination of the slope 71 is large, a distance between the outlet 73 and the slope surface is reduced. As a result, a developer which cannot flow may be deposited to clog the outlet 73.

For this reason, an optimal range of the angle of inclination of the slope 71 exists. However, it largely depends on an angle of repose whether or not a discharged developer is deposited on the slope.

Here, the angle of repose indicates an angle of a slope at which the powder of a developer maintains a stable state without flowing and is a property value measured by a physical property measuring method defined in JISR9301-2-2.

However, it is known that an angle of repose of an initial developer is about 35° but the angle of repose gradually increases because a coating agent of a carrier is peeled off or dropped or an additive of toner adheres to the carrier surface due to stirring in the developing device 30. Moreover, the angle of repose is also influenced by an environment or the toner concentration of the developer.

Accordingly, it is difficult to solve the problem that a developer is deposited on the slope 71 to clog the outlet 73 only by optimizing the angle of inclination.

For this reason, the reciprocating member 60 which moves on the slope 71 of the guide 70 is provided. In this case, since a developer is not deposited on the slope 71, the developer can be made to flow smoothly by the gravity.

As shown in FIGS. 3A to 3E, the reciprocating member 60 is configured to include: an operation portion 62 which moves back and forth along a fan-shaped sweep range R; a rotating shaft 63 which is rotatably supported on a rotation center 61; and a slide contact portion 64 which moves in conjunction with a rotational movement of the stirring screw 32.

In this case, the slide contact portion 64 located at one end of the reciprocating member 60 comes in slide contact with a surface of the stirring screw 32, and the operation portion 62 located at the other end wipes the sweep range R of the flow surface of the slope 71.

In the configuration described above, a driving unit that interlocks the reciprocating member 60 does not need to be provided separately and the reciprocating member 60 can be made to have a simple configuration.

Here, the reciprocating member 60 is formed of a wire with a diameter of about 0.5 mm, and the entire reciprocating member 60 including the slide contact portion 64 may be formed of a piece of continuous wire. In addition to the plate shape shown in the drawing, the slide contact portion 64 may be applied only by bending the wire tip in the U shape.

However, the reciprocating member 60 in the invention is not limited to the embodiment, but any reciprocating member may be used as long as it moves on the slope 71 of the guide 70. In addition, any one other than the stirring screw 32 may be adopted as a driving source of the reciprocating member 60.

In such a configuration, when the flow surface of the slope 71 is a gentle slope, the fluidity of a developer discharged from the developing device 30 is reduced because the gravity component in a fall line direction of the slope is small. However, since the kinetic energy is given to the developer by the reciprocating member 60 which, the fluidity of the developer can be improved. Accordingly, the slope of the flow surface 71 can flow the developer along the fall line.

An operation of the reciprocating member 60 will be described with reference to FIGS. 3A to 3E. Here, FIGS. 3A to 3E show cases where the stirring screw 32 is made to rotate ¼. A left column shows views seen from an X-Z plane, a middle column shows views seen from a Y-X plane, and a right column shows views seen from a Y-Z plane.

Figures 3A, 3B, 3C, 3D, 3E:
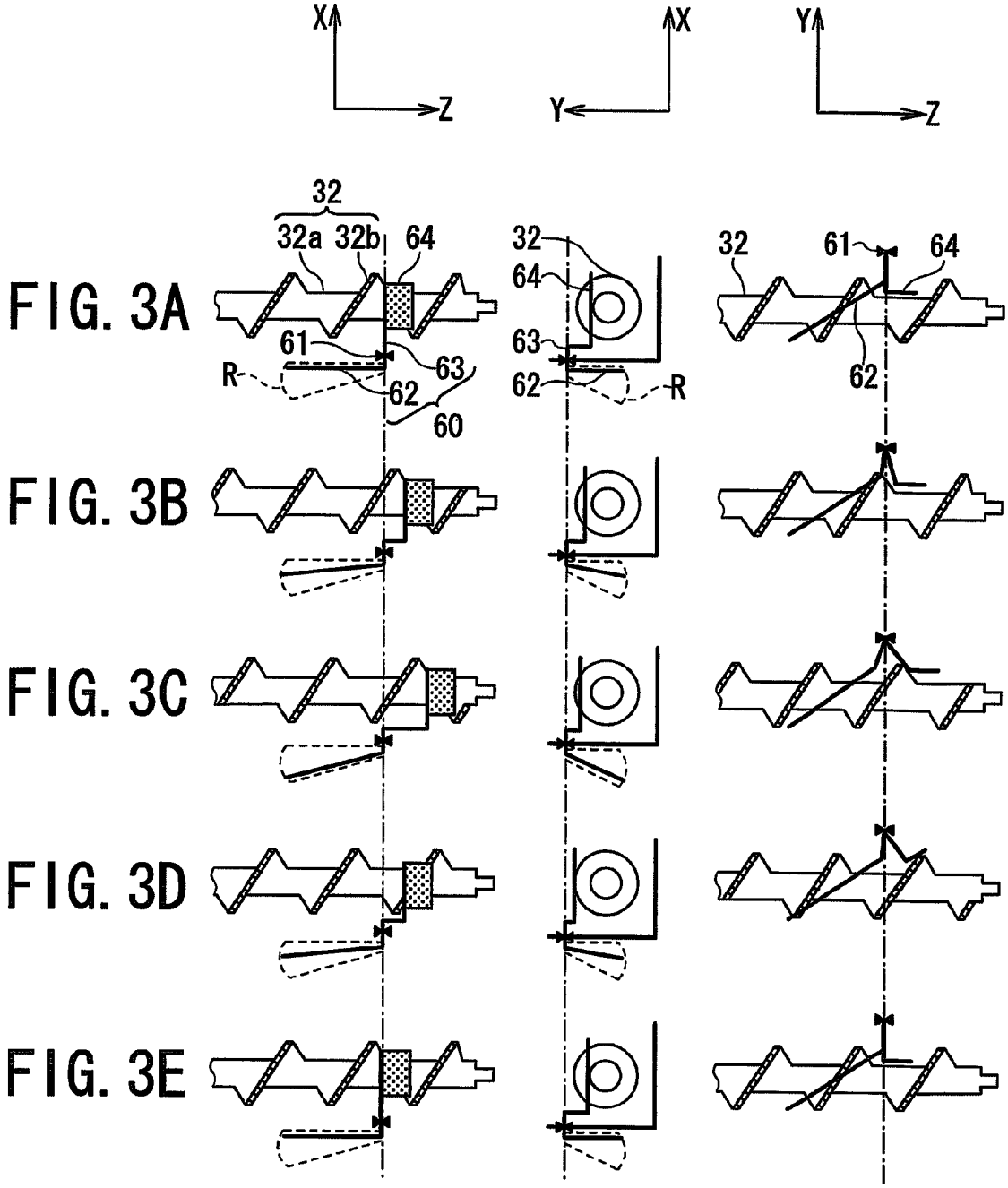
FIGS. 3A to 3E are views explaining an operation of a reciprocating member when a screw is made to rotate ¼ in the image forming apparatus according to the embodiment.

First, when the stirring screw 32 is made to rotate ¼ in an initial state of FIG. 3A, the slide contact portion 64 is pushed by the flight 32*b* and moves as shown in FIGS. 3B and 3C. Then, the twisting power is generated in the rotating shaft 63, which causes torque having the rotation center 61 as a center in the operation portion 62. The operation portion 62 for which the torque is caused is displaced to wipe the fan-shaped sweep range R.

Then, when the stirring screw 32 rotates, the slide contact portion 64 is willing to return to the original position over the flight 32*b* by the restoring force of the rotating shaft 63 which is twisted to deform, as shown in FIG. 3D. At this time, the operation portion 62 is also displaced in the reverse direction in synchronization with the movement of the flight 32*b*.

Then, as shown in FIG. 3E, the reciprocating member 60 also returns to the initial state when the stirring screw 32 makes one rotation from the initial state (FIG. 3A).

Thus, the operation portion 62 moves back and forth along the sweep range R once whenever the stirring screw 32 makes one rotation, and the operation portion 62 wipes the sweep range R when the stirring screw 32 rotates continuously.

When the number of rotations of the stirring screw 32 is set to 358 rpm, for example, the reciprocating member 60 wipes the sweep range R while moving back and forth about six times for one second.

Figure 4A:
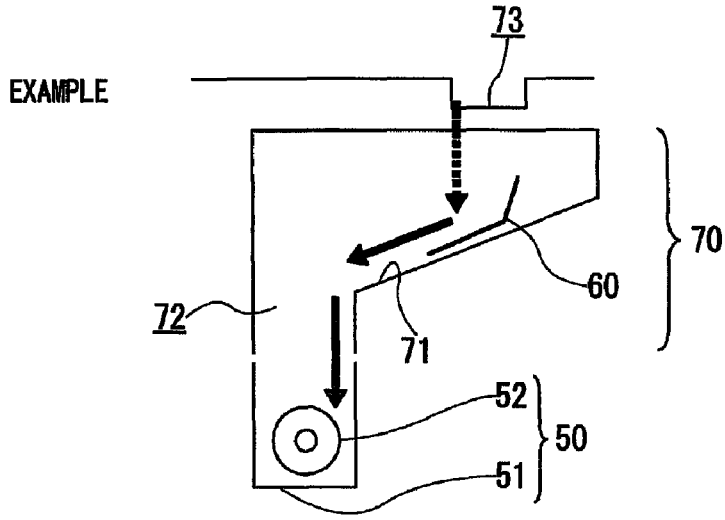
FIG. 4A is a view illustrating an internal state of a guide which flow a surplus developer, which is discharged from the developer discharge mechanism in the embodiment, to a collection portion.

As shown in FIG. 4A, a developer overflowed from the outlet 73 of the developing device 30 (FIG. 1B) drops through a space of the guide 70 and lands on the slope 71, and then flows to be guided to the collection portion 50. Even if an overflowed developer is deposited at a landing point of the slope 71 due to a decrease in the fluidity of the surplus developer, the surplus developer moves to the collection portion 50 without being deposited in the middle of the guide 70 by movement of the reciprocating member 60.

Figure 4B:
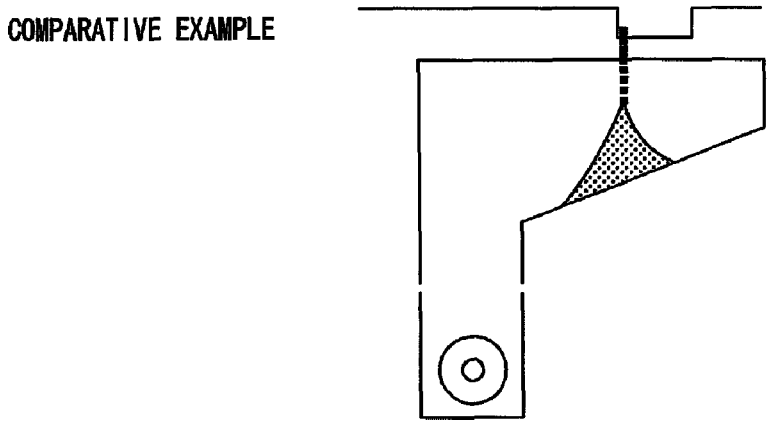
FIGS. 4B and 4C are views illustrating internal states of guides in comparative examples where there is no reciprocating member.
Figure 4C:
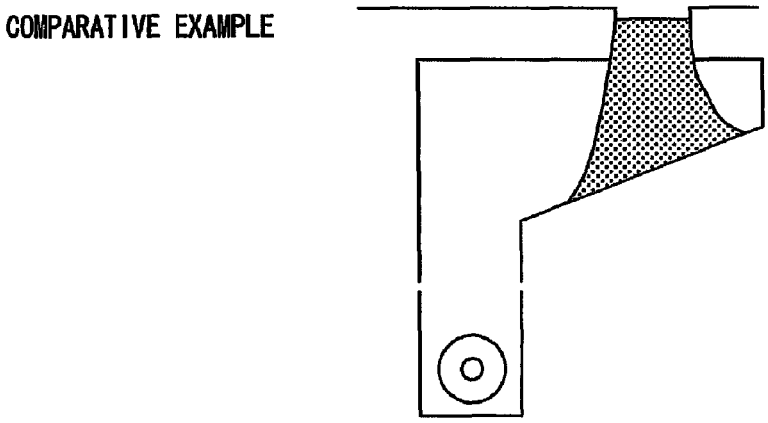

On the other hand, when there is no reciprocating member 60 like comparative examples shown in FIGS. 4B and 4C, a developer may be deposited on the slope 71 (FIG. 4B) depending on conditions. In a worst case, the developer may clog the outlet 73 (FIG. 4C).

Referring to FIGS. 5A and 5B, examples of an experiment for proving the effects of the invention are shown.

FIG. 5A is a table in which an experimental result in a developing device including the developer discharge mechanism according to the embodiment of the invention is summarized, and FIG. 5B is a table in which an experimental result in a comparative example where there is no reciprocating member is summarized.

Three kinds of developer samples with different angles of repose were prepared as developers.

The first sample was a developer A with a toner concentration of 8.5% made by using a carrier with a volume average particle diameter of 60 μm, which was obtained by performing silicon-based resin coating on a ferrite core, and black toner with a volume average particle diameter of 6 μm using a polyester resin as a main material.

When the angle of repose of the developer A related to the first sample was measured, it was about 35°.

Here, the angle of repose was set as an angle obtained in a way of dropping the developer using a funnel from the position of about 50 mm above a circular base of about 80 mm in diameter and measuring the angle of the skirt of the mount when the mount of the developer deposited on the circular base was observed from the side surface. In addition, the diameter of a lower portion of the funnel is about 5 mm.

A developer B after printing about 60 k pieces of paper with the developer A at 6% of printing rate using the copying machine by Toshiba TEC Corp. is assumed to the second sample.

When the angle of repose of the developer B related to the second sample was measured, it was about 38°.

In addition, a developer C after printing about 140 k pieces of paper with the developer A at 6% of printing rate using the copying machine by Toshiba TEC Corp. is assumed to the third sample.

When the angle of repose of the developer C related to the third sample was measured, it was about 40°.

Then, three different kinds of guides 70 were prepared for the experiment, of which angles of inclination of the slope 71 were 40°, 55°, and 65° respectively. Moreover, the guide 70 in which the reciprocating member 60 was provided on the slope 71 having an angle of inclination and a guide in which the reciprocating member 60 was not provided on the slope 71 having an angle of inclination were prepared.

The amount of developer stored in the casing 33 was set to about 400 g. That is, if the developer enters more than 400 g, it is discharged through the outlet 73. In this state, additional 50 g of the developer was supplied to confirm whether or not the discharged developer would be deposited on the slope. The result is shown in FIGS. 5A and 5B.

FIG. 5A shows a case where the reciprocating member 60 is provided on the slope 71.

Regardless of the developer A (angle of repose of 35°), the developer B (angle of repose of 38°), and the developer C (angle of repose of 40°), the developers were not deposited on the slope. Also, regardless of the slope angles (40°, 55°, 65°), the developers were not deposited on the slope.

FIG. 5B shows a case where the reciprocating member 60 is not provided on the slope 71.

The developer A (angle of repose of 35°) was not deposited on the slope regardless of the slope angles.

The developer B (angle of repose of 38°) was not deposited on the slope at the slope angles of 55° and 65°. However, when the slope angle was 40°, the developer B was deposited on the slope. In this case, the developer B discharged as time went by was gradually deposited on the slope, and finally its level rose above the outlet.

The developer C (angle of repose of 40°) was not deposited on the slope at the slope angle of 65°. However, when the slope angle was 40° and 55°, the developer C was deposited on the slope.

As described above, disposing a reciprocating member on the flow surface of the guide 70 which guides the developer discharged from the developing device 30 is able to maintain stabilized image formation by preventing the outlet 73 of the developing device 30 from being clogged.

The invention is not limited to the above-described embodiment, but may be suitably modified within the common technical scope of the invention.

For example, a monochrome image forming apparatus may also be used, even though a color image forming apparatus was illustrated. In this case, the photoconductive drum 21 may directly transfer the toner to paper (transferred body) with no need of the transfer belt 14.

In addition, the screw was illustrated as a driving source of the reciprocating member, but an exclusive driving source may be disposed.

Furthermore, the case where the reciprocating member was disposed on the slope surface because the developer was easy to be deposited on the slope surface was illuminated. However, this arrangement position is not limited, either. That is, a reciprocating member may be disposed on a flow surface that is a surface which forms a space where flowing developer would be easily clogged.

Moreover, it is also possible to adopt a method of attaching a piezoelectric element to the outer side of a sidewall of the slope as a reciprocating member, instead of the operation portion 62 which moves back and forth along the sweep range R (FIG. 3), so that a portion on which the developer flows can be intensively vibrated.

Specifically, a piezoelectric element (vibration generating portion) which vibrates at the frequency of 5 kH was provided on a bottom surface of the slope 71 of the guide 70 under the same conditions as the experiment example executed in FIGS. 5A and 5B. In this case, the same result as the table shown in FIG. 5A was obtained, and the effect was confirmed.

That is, a reciprocating member does not have the capability for self to convey a developer, what is necessary is to give vibration to the developer on a slope, and just to have the function to promote a flow by gravity.

What is claimed is:

1. An image forming apparatus comprising:

a developing device that electrify toner by stirring together with a carrier, and make toner image carried on a photoconductive drum;

a supply portion that supplies a developer, in which the toner and the carrier are mixed, to the developing device;

a collection portion that collects the surplus developer discharged from the developing device;

a guide that guides the surplus developer from the developing device to the collection portion; and a reciprocating member that moves on a flow surface of the guide along which the surplus developer flows.

2. The apparatus according to claim 1, wherein the flow surface is a slope inclined toward the collection portion.

3. The apparatus according to claim 2, wherein the reciprocating member moves in conjunction with a rotational movement of a stirring screw of the developing device.

4. The apparatus according to claim 3, wherein the reciprocating member is rotatably provided in the developing device, and one end of the reciprocating member is in slide contact with a surface of the stirring screw and the other end wipes the flow surface.

5. The apparatus according to claim 1, wherein the reciprocating member moves in conjunction with a rotational movement of a stirring screw of the developing device.

6. The apparatus according to claim 5, wherein the reciprocating member is rotatably provided in the developing device, and one end of the reciprocating member is in slide contact with a surface of the stirring screw and the other end wipes the flow surface.

7. A developing device used in an image forming apparatus having a photoconductive drum that makes toner image carried on its surface, comprising:

a stirring screw that electrify toner by stirring the toner together with a carrier;

a casing that supports the stirring screw and stores a developer in which the toner and the carrier are mixed;

a inlet used to supply the developer to the casing;

an outlet that discharges the surplus developer from the casing; and a reciprocating member that moves on a flow surface along which the surplus developer flows from the outlet.

8. The device according to claim 7, wherein the flow surface is a slope inclined toward a collection portion that collects a surplus developer.

9. The device according to claim 7, wherein the reciprocating member moves in conjunction with a rotational movement of the stirring screw.

10. The device according to claim 9, wherein the reciprocating member is rotatably provided in the casing, and one end of the reciprocating member is in slide contact with a surface of the stirring screw and the other end wipes the flow surface.

11. A developer discharge mechanism used in an image forming apparatus having a photoconductive drum that makes toner image carried on its surface, comprising:

a stirring screw that electrify toner by stirring the toner together with a carrier;

a casing that supports the stirring screw and stores a developer in which the toner and the carrier are mixed;

a inlet used to supply the developer to the casing;

a guide that guides the surplus developer discharged from the casing downward; and a reciprocating member that moves on a flow surface of the guide along which the surplus developer flows.

12. The mechanism according to claim 11, wherein the flow surface is a slope inclined toward a collection portion that collects a surplus developer.

13. The mechanism according to claim 11, wherein the reciprocating member moves in conjunction with a rotational movement of the stirring screw.

14. The mechanism according to claim 9, wherein the reciprocating member is rotatably provided in the casing, and one end of the reciprocating member is in slide contact with a surface of the stirring screw and the other end wipes the flow surface.

* * * * *